US010493600B2

(12) United States Patent
Chardonnet et al.

(10) Patent No.: US 10,493,600 B2
(45) Date of Patent: Dec. 3, 2019

(54) SYSTEM FOR CLAMPING A PART AND METHOD FOR SEALING THE INNER CASING OF A LOW PRESSURE RECTIFIER OF A TURBOMACHINE

(71) Applicant: SAFRAN AIRCRAFT ENGINES, Paris (FR)

(72) Inventors: Romain Rene Marcel Chardonnet, Moissy-Cramayel (FR); Jean-Yves Francois Henri Maillet, Moissy-Cramayel (FR); Erwan Soubigou, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 51 days.

(21) Appl. No.: 15/118,457

(22) PCT Filed: Feb. 12, 2015

(86) PCT No.: PCT/FR2015/050354
§ 371 (c)(1),
(2) Date: Aug. 11, 2016

(87) PCT Pub. No.: WO2015/121592
PCT Pub. Date: Aug. 20, 2015

(65) Prior Publication Data

US 2017/0173762 A1 Jun. 22, 2017

(30) Foreign Application Priority Data

Feb. 14, 2014 (FR) ..... 14 51204

(51) Int. Cl.
*B25B 5/14* (2006.01)
*B25B 5/06* (2006.01)
(Continued)

(52) U.S. Cl.
CPC ..... *B25B 5/14* (2013.01); *B25B 5/061* (2013.01); *F01D 9/02* (2013.01); *F01D 25/285* (2013.01);
(Continued)

(58) Field of Classification Search
CPC ..... F03D 7/0224; F03D 7/046; F03D 7/0256; F03D 80/55
See application file for complete search history.

(56) References Cited

U.S. PATENT DOCUMENTS 3,566,068 A 2/1971 Bruner et al.
3,905,279 A * 9/1975 Yadon ..... F15B 13/01 92/110

(Continued)

FOREIGN PATENT DOCUMENTS

CN 102083592 A 6/2011
EP 1310331 A2 5/2003
FR 2989414 A1 10/2013

OTHER PUBLICATIONS

Search Report and Written Opinion in French Application No. 1451204 dated Nov. 5, 2014, with English translation coversheet. 9 pages.

(Continued)

*Primary Examiner* — Moshe Wilensky
(74) *Attorney, Agent, or Firm* — Womble Bond Dickinson (US) LLP

(57) ABSTRACT

The invention relates to a clamping system (1) comprising a clamping jaw (7) mounted on the shaft of a pneumatic or hydraulic cylinder (4), wherein said cylinder has a structure which drives the clamping jaw towards its clamping position when the pneumatic or hydraulic energy supply of the cylinder is interrupted, the pneumatic or hydraulic energy supply of the cylinder opposing the clamping, and where
(Continued)

means (8) are provided for locking the cylinder when the clamping jaw is in a non-clamped position.

7 Claims, 2 Drawing Sheets

(51) Int. Cl.
*F01D 25/28* (2006.01)
*F01D 9/02* (2006.01)

(52) U.S. Cl.
CPC ..... *F05D 2220/30* (2013.01); *F05D 2230/30* (2013.01); *F05D 2300/516* (2013.01)

(56) References Cited

U.S. PATENT DOCUMENTS

2007/0006635 A1* 1/2007 Pabich ..... B21D 5/0209 72/481.1
2008/0223248 A1* 9/2008 Schutte ..... B61B 15/00 104/124
2009/0315239 A1* 12/2009 Yonezawa ..... B23Q 1/009 269/309
2014/0255119 A1* 9/2014 Herzog ..... B61D 3/16 410/44

OTHER PUBLICATIONS

International Search Report and Written Opinion of the ISA in PCT/FR2015/05034 dated May 27, 2015, with English translation. 14 pages.
International Preliminary Report on Patentability received for PCT Patent Application No. PCT/FR2015/050354, dated Aug. 25, 2016, 12 pages (6 pages of English Translation and 6 pages of Original Document).

* cited by examiner

SYSTEM FOR CLAMPING A PART AND METHOD FOR SEALING THE INNER CASING OF A LOW PRESSURE RECTIFIER OF A TURBOMACHINE

GENERAL TECHNICAL FIELD AND PRIOR ART

The present invention generally relates to clamping of parts.

It finds application advantageously in the field of aeronautics for the implementation of sealing operations and/or abradable material injection on inner ferrules of low-pressure guide vanes of turbine engines.

PRIOR ART

It is conventional to hold parts in precise positions on work benches using reference clamps.

In particular, clamping systems with manual adjustment are known. Such a system comprises for example a holding pad which forms a first jaw and which is coupled to a clamping screw. Said clamping screw runs through said pad and is engaged in a reference support on which it is desired to position the part during work.

Such a manual system has the disadvantage of not allowing uniform clamping from one clamp to another and requiring long setup times.

Moreover, the force exerted on the part is not repeatable and can be strongly variable from one operator to another.

In addition, clamping systems using hydraulic or pneumatic control are known.

There, clamping is accomplished by hydraulic or pneumatic compression.

This assumes however that a considerable hydraulic or pneumatic energy store is available, and to be able in particular to have safety reserves to deal with cases of possible failure in production of hydraulic or pneumatic energy.

The matter of energy and the maintenance of these systems are expensive.

The control and supervision of the clamping pressure has also proven to be complex.

Moreover, these techniques are poorly adapted to sealing operations and/or abradable material injection on inner ferrules of a low-pressure guide vane of a turbine engine.

In fact, during these operations, the guide vane must be put in rotation. Clamping by pneumatic or hydraulic energy would make it necessary to be able to accompany this rotation with winding of the hydraulic or pneumatic supply pipes, which is particularly complex to organize.

In particular, the centre of the guide vane cannot be used to allow such pipes to pass through, given that it is used for other functions in these operations.

Among these clamping system with hydraulic or pneumatic control, there are systems for which the control triggers the disengagement of the system (document EP 1 310 331 A2).

GENERAL PRESENTATION OF THE INVENTION

One aim of the invention is to resolve the problems of the prior art and to propose a system that does not have the aforementioned disadvantages.

More particularly, the invention proposes a clamping system including a clamping jaw mounted on the rod of a pneumatic or hydraulic ram, wherein said ram is a structure which, when supply to said ram of pneumatic or hydraulic energy is cut off, drives the clamping jaw toward its clamping position, supply to said ram of pneumatic or hydraulic energy opposing said clamping, characterized in that it includes means of locking the ram when the clamping jaw is in the release position.

The clamping system proposed makes it possible to hold the part clamped when the pneumatic supply is cut off. The various needs for supply, for energy storage, etc. are thereby eliminated.

Clamping is made very reliable and without risk for the operator.

In particular, clamping is made repeatable, whatever the type of clamp.

Because it is made permanent, the system requires few or no maintenance operations.

The invention also proposes a method of sealing and/or injection of abradable material on the inner ferrule of a low-pressure guide vane of a turbine engine, characterized in that it comprises the following steps:

- positioning, on a work bench, clamps including a clamping system of the aforementioned type,
- positioning the guide vane on said bench,
- removing the locking means of the ram located at the outer ferrule,
- clamping at least one clamp by cutting off its pneumatic or hydraulic supply.

It also proposes tooling for sealing and/or injection of abradable material on the inner ferrule of a low-pressure guide vane of a turbine engine, characterized in that it includes a work bench and at least one clamp including such a clamping system.

PRESENTATION OF THE FIGURES

Other features and advantages of the invention will still be revealed by the description that follows, which is purely illustrative and not limiting, and must be read with reference to the appended figures wherein.

DESCRIPTION OF ONE OR MORE EMBODIMENTS OR IMPLEMENTATIONS

Figure 1:
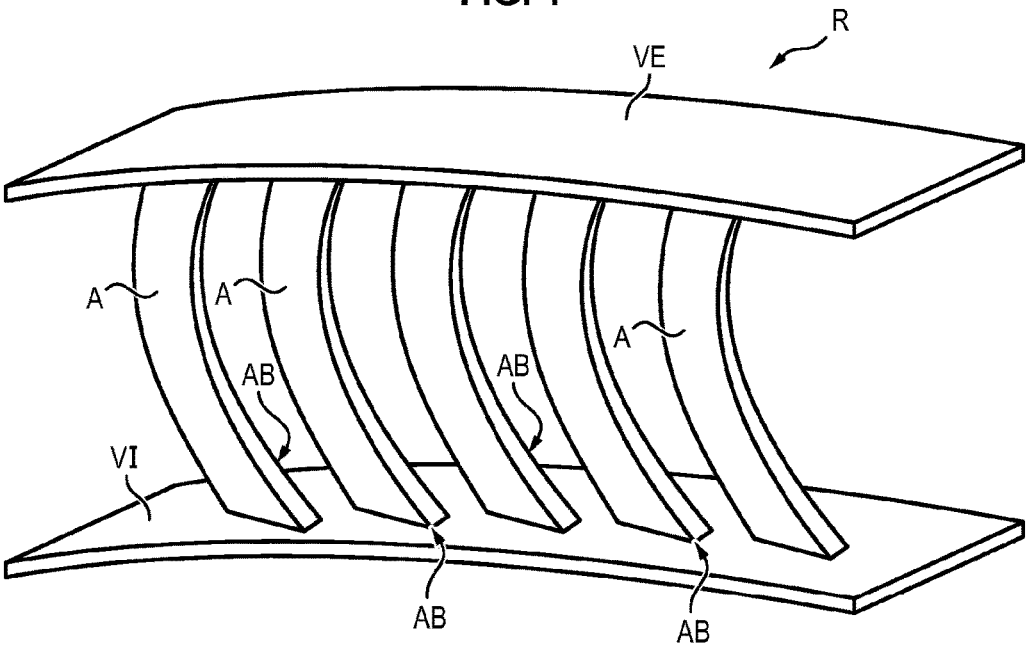
FIG. 1 shows schematically in perspective a low-pressure guide vane of a turbine engine.

The guide vane R illustrated in FIG. 1 comprises an inner ferrule VI, an outer ferrule VE and blades A assembled by welding to the inner ferrule VE.

These blades A are secured with the inner ferrule VI through an abradable surface AB.

The deposit of this abradable surface is accomplished during sealing and injection operations requiring clamping of the outer ferrule VE and the inner ferrule VI on a support structure of a work bench.

To this end, the inner ferrule VI and the outer ferrule VE are held at several points by means of reference clamps.

Figure 2:
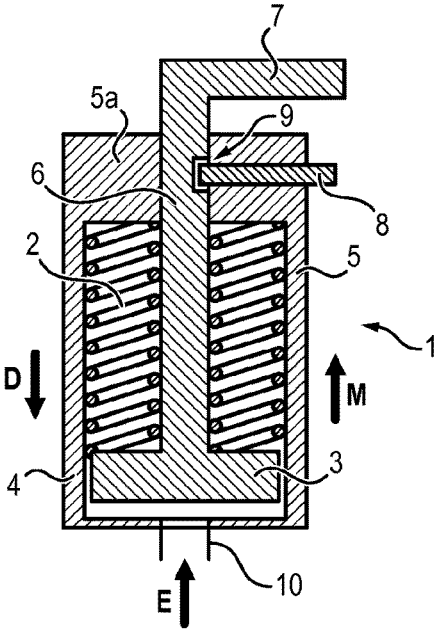
FIG. 2 illustrates schematically the principle of a positive clamping system conforming to a possible embodiment of the invention.

To accomplish this, it is proposed to use clamping systems with permanent clamping of the system 1 type illustrated in FIG. 2.

Such a clamping system is a system including one or more springs 2 exerting a force on the piston 3 of a ram 4 which is used to accomplish said clamping.

The hydraulic/pneumatic circuit 10 is provided, but only to ensure release of the clamping system 1, no supply being required for clamping.

In the schematic example illustrated in FIG. 2, one or more spring(s) 2 is (are) compressed between the piston 3 and the bottom 5*a* of the body 5 of the ram 4. The piston 3 is secured to the rod 6 of the ram, which extends out of the body 5. At its end opposite the piston 3, said rod 6 is itself secured to a clamping jaw 7.

A cam 8 is provided for blocking the clamping jaw 7 and the rod 6 in a high, disengaged position (release position). To this end, said cam 8 cooperates with a groove 9 which the rod 6 has and in which it is possible to engage said cam 8 when the jaw 7 is in the high position.

The positioning of the cam on the ram 4 or its disengagement is for example carried out manually.

When the cam 8 and the groove 9 are disengaged, the springs 2 push back the piston 3 of the ram 4. Said piston 3 moves within the body 5 of the ram 4. The jaw 7, which moves with the piston 3, is movable in the descending direction along arrow D to accomplish the clamping of the part to be clamped.

Release is obtained by supplying pneumatic energy from the circuit 10 along arrow E. A force is exerted against the piston 3, which is movable in the rising direction along arrow M within said body 5 and compresses the springs 2.

When the pneumatic/hydraulic energy is cut off, on the other hand, the springs 2 exert their compression force, but the jaw 7 remains in its high, release position if the cam 8 has been engaged in the groove 9.

It can further be provided that the movement of the piston 3 and the rod 6 within the body 5 of the ram 4 occurs in a helical movement making it possible to have the jaw 7 rotate 90 degrees on itself when it moves toward the release position. Such a helical movement facilitates the disengagement of the part to be clamped.

Figure 3:
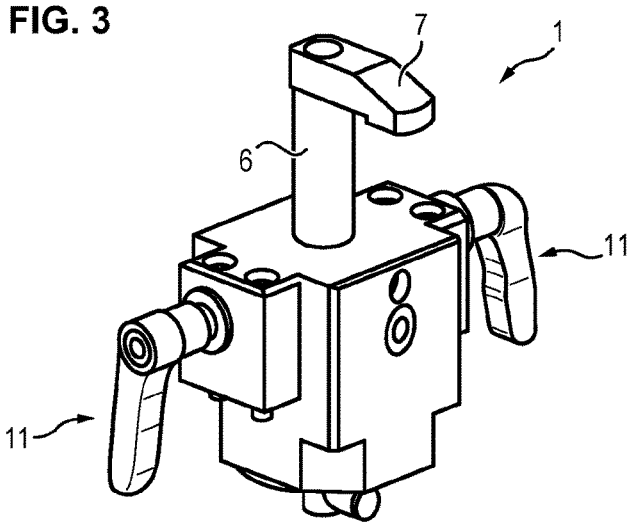
FIG. 3 shows in perspective an embodiment for the clamping system of FIG. 2.

Moreover, as shown in FIG. 3, the body 5 of the ram 4 can be associated with different means 11 (clamping jaws for example) which make it possible to attach the system 1 with precision to a given support.

Figure 4:
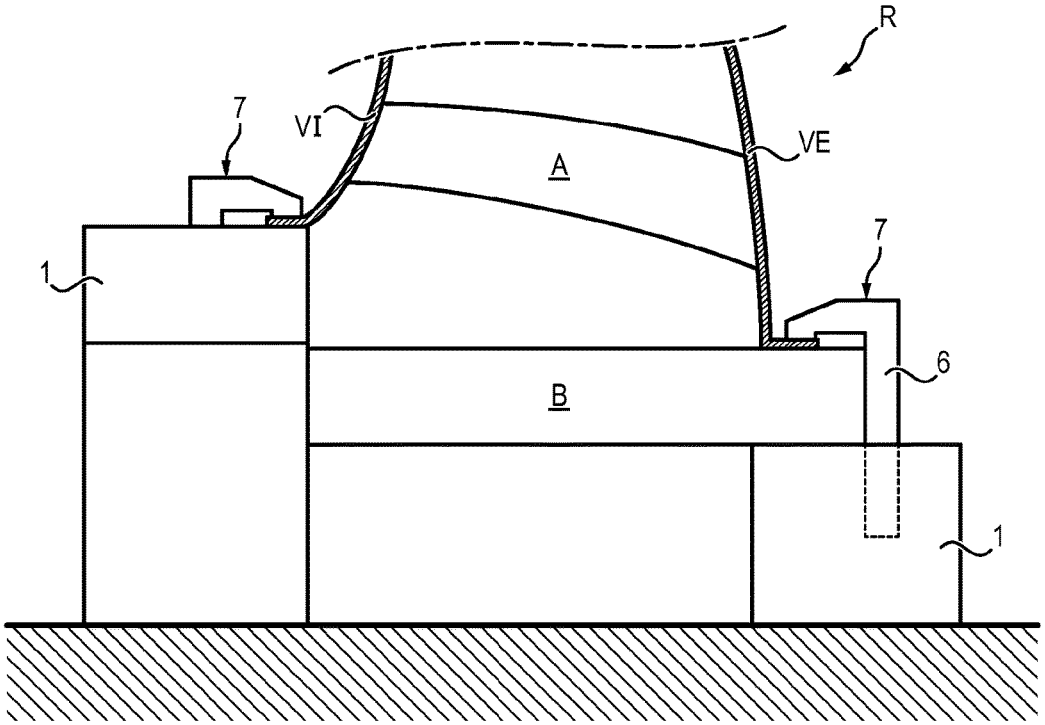
FIG. 4 illustrates a utilization example for clamping the inner ferrule or the outer ferrule of a low-pressure guide vane of a turbine engine.

FIG. 4 illustrates the use of the clamping system of the system 1 type which was just described to accomplish the positioning of the ferrules VI and VE of a guide vane R on a work bench B.

The different reference clamps 1 are first of all attached precisely to the bench B using the attachment means 11 (FIG. 3) which they comprise, the clamps 1 and the bench B constituting a portion of the intervention tooling.

Then the guide vane R is installed on said bench B.

The blocking cams of the reference clamps 1 located at the outer ferrule VE are then removed.

These reference clamps 1 are then clamped to the outer ferrule VE by cutting off the pneumatic pressure in the circuit.

The ferrule VE thus being clamped, clamping of the outer ferrule VI is then carried out.

The guide vane R thus being held in position on the work bench B, the sealing operations are accomplished on inner surfaces of the inner ferrule as well as in its mortises.

Sealing is accomplished for example by depositing RTV silicone. This makes it possible to generate sealing of the path prior to injection of the abradable material itself.

The polymerization of the abradable material is then accomplished on the mortises of the inner ferrule.

The release/unlocking of the different clamps 1 is then ensured by putting the different clamps under hydraulic/pneumatic pressure.

When the different cams 8 are repositioned, the hydraulic/pneumatic pressure can again be cut off.

The reference clamps 1 can then be removed.

When the clamps 1 are not used, the cams 8 can be disengaged so as to limit the loading of the springs 2.

It is understood that the energy thus required for accomplishing clamping is small.

Moreover, the clamping that is carried out is particularly reliable and is not dependent on the level of hydraulic/pneumatic pressure provided by the circuits.

It is repeatable, the clamping being the same no matter which clamp it is.

It is accomplished quickly and without effort by the user who carries out the clamping.

It does not require large amounts of hydraulic/pneumatic energy storage.

It requires only very little maintenance.

The invention claimed is:

1. A clamping system comprising:

a pneumatic or hydraulic ram, including a rod, a clamping jaw mounted on the rod of the pneumatic or hydraulic ram, wherein said ram is a structure, a supply of pneumatic or hydraulic energy opposes the clamping of the clamping jaw, and the clamping jaw is driven to its clamping position when the supply of pneumatic or hydraulic energy is cut off, wherein said ram includes a piston, the rod to which said piston and said clamping jaw are secured and at least one compression spring which acts against the piston, the clamping jaw being linked to said piston and being displaced, to accomplish a clamping by said clamping jaw, under the compression force of said at least one compression spring, and and wherein said clamping system further comprises a manually actionable cam for blocking the clamping jaw when said clamping jaw is in a release position, the rod comprising a groove to engage said cam when the jaw is in said release position.

2. The clamping system according to claim 1, wherein the structure of the ram is adapted so that the displacement of the clamping jaw between its clamping and release positions occurs in a helical movement.

3. The clamping system according to claim 2, wherein the rotation of the clamping jaw between the clamping and release positions is 90°.

4. A method of sealing and/or injection of abradable material on an inner ferrule of a low-pressure guide vane of a turbine engine, wherein the method includes the following steps of:

positioning, on a work bench, clamps including a clamping system comprising a clamping jaw mounted on the rod of a pneumatic or hydraulic ram, wherein said ram is a structure which, when a supply to said ram of pneumatic or hydraulic energy is cut off, drives the clamping jaw toward its clamping position, said supply to said ram of pneumatic or hydraulic energy opposing said clamping position, said ram including a piston, the rod to which said piston and said clamping jaw are secured and at least one compression spring which acts against the piston, the clamping jaw being linked to said piston and being displaced, to accomplish clamping by said clamping jaw, under the compression force of said at least one compression spring, said clamping system further comprising a manually actionable cam for blocking the clamping jaw when said clamping jaw is in a release position, the rod comprising a groove in which it is possible to engage said cam when the jaw is in said release position, positioning the guide vane on said bench, manually disengaging the cam from the rod, clamping at least one of said clamps by cutting off its pneumatic or hydraulic supply.

5. The method according to claim 4, wherein the clamping of the outer ferrule is carried out, then the clamping of the inner ferrule.

6. The method according to claim 4, wherein, after the sealing and/or polymerization operations, the clamps are unlocked by said pneumatic or hydraulic supply.

7. The tooling for sealing and/or injection of abradable material on an inner ferrule of a low-pressure guide vane of a turbine engine, wherein said tooling includes a work bench and at least one clamp including a clamping system according to claim 1.

* * * * *